US007241207B2

(12) United States Patent
Heesemann

(10) Patent No.: US 7,241,207 B2
(45) Date of Patent: Jul. 10, 2007

(54) GRINDING MACHINE AND METHOD FOR GRINDING A WORKPIECE

(76) Inventor: Jurgen Heesemann, Gruener Weg 52, 32547 Bad Oeynhausen (DE)

( * ) Notice: Subject to any disclaimer, the term of this patent is extended or adjusted under 35 U.S.C. 154(b) by 0 days.

(21) Appl. No.: 10/525,041

(22) PCT Filed: Jul. 22, 2003

(86) PCT No.: PCT/DE03/02439

§ 371 (c)(1),
(2), (4) Date: Jun. 22, 2005

(87) PCT Pub. No.: WO2004/020146

PCT Pub. Date: Mar. 11, 2004

(65) Prior Publication Data

US 2005/0255799 A1 Nov. 17, 2005

(30) Foreign Application Priority Data

Aug. 21, 2002 (DE) ..... 102 39 191

(51) Int. Cl.
*B24B 7/00* (2006.01)
*B24B 9/00* (2006.01)
*B24B 21/00* (2006.01)

(52) U.S. Cl. ..... 451/59; 451/164; 451/167; 451/168; 451/299; 451/300; 451/304

(58) Field of Classification Search ..... 451/299–301, 451/303, 304, 169, 164, 167, 168, 270, 271, 451/260, 534; 125/18, 19, 21
See application file for complete search history.

(56) References Cited

U.S. PATENT DOCUMENTS 2,162,279 A * 6/1939 Herchenrider ..... 451/301
2,586,848 A * 2/1952 Miller ..... 451/303
3,263,376 A 8/1966 Walters
3,570,190 A 3/1971 Rutt
4,742,650 A * 5/1988 Sauder et al. ..... 451/300
5,707,273 A * 1/1998 Grivna ..... 451/163
6,001,004 A 12/1999 Botteghi
6,200,206 B1 3/2001 Drees
6,231,427 B1 * 5/2001 Talieh et al. ..... 451/41
6,299,512 B1 * 10/2001 Costa et al. ..... 451/59

FOREIGN PATENT DOCUMENTS

| | | | |
|---|---|---|---|
| DE | NR 226105 | | 2/1963 |
| DE | NR226105 | * | 2/1963 |
| DE | 1 921 566 | | 12/1970 |
| DE | GM 79 12 841 | | 8/1979 |
| DE | 27 57 314 B2 | | 3/1980 |
| DE | EP 0 53 947 B1 | | 8/1991 |
| DE | 100 41 925 A1 | | 3/2002 |
| EP | 0 155 380 B1 | | 11/1987 |
| EP | 0 389 914 A1 | | 3/1990 |
| WO | WO 02/32623 | | 4/2002 |

* cited by examiner

*Primary Examiner*—Joseph J. Hail, III
*Assistant Examiner*—Bryan R. Muller
(74) *Attorney, Agent, or Firm*—Greenblum & Bernstein, P.L.C.

(57) ABSTRACT

Disclosed is a grinding machine comprising oscillating driving means (3, 4) for setting grinding means (1) into an oscillating grinding motion and an actuation device (7) that is provided with a plurality of actuation areas (8) which can be triggered such that different zones of the grinding means (1) are alternately actuated independently of the oscillating grinding motion.

8 Claims, 7 Drawing Sheets

GRINDING MACHINE AND METHOD FOR GRINDING A WORKPIECE

FIELD OF THE INVENTION

The invention relates to a sanding machine having oscillation drive means for setting abrasives in an oscillating sanding movement.

Furthermore, the invention relates to a method of sanding a workpiece using such a sanding machine by oscillating sanding movements.

BACKGROUND OF THE INVENTION

Such a sanding machine is described, for example, in the embodiment of a belt sanding machine in EP 0 543 947 B1. In this case, an abrasive adhering to a plate is coupled by oscillation drive means to a sanding machine frame in such a way that a translatory orbital movement is superimposed on a second movement of the plate relative to the sanding machine frame. The two superimposed movements are intended to prevent a regular sanding pattern from being produced. The two superimposed movements are coupled to one another.

For example, EP 0 155 380 B1 discloses a belt sanding machine which has a link pressure beam with a multiplicity of pressure shoes arranged next to one another. The pressure shoes are triggered as a function of the contour, to be processed, of the workpiece in such a way that only the pressure shoes actually required for the workpiece are in an effective sanding position and press the abrasive in these pressure regions onto the workpiece.

Furthermore, DE 27 57 314 and DE 1 921 566 disclose sanding machines having pneumatically operated pressure beams. The pneumatically operated pressure beams are triggered by solenoid valves, so that the reaction time is disadvantageously relatively long.

Disclosed in Austrian Patent AT 226105 is a non-oscillating belt sanding machine in which a lamella-like pressure strip is moved at reduced speed parallel to an endless sanding belt. Due to the lamella-like surface of the pressure belt, which rests on the inside of the endless sanding belt and is pressed together with the latter onto the workpiece, the pressure on the sanding belt is not uniform over the sanding surface. On the contrary, the pressure is exerted on the sanding belt in a continuously shifting manner and in a finely distributed manner at intervals over the entire length of the workpiece, so that the quality of the sanding and also of the sanding performance can be substantially improved. In this case, the belt sanding machine is rigid and performs no oscillating sanding movement.

SUMMARY OF THE INVENTION

The object of the invention is to provide an improved sanding machine with which sanding marks can be reduced and a uniform sanding pattern can be ensured and in which sanding dust is optimally discharged.

This object is achieved with the sanding machine of the generic type in that the activating device has a multiplicity of activating regions triggered in such a way that various regions of the abrasive are alternately activated independently of the oscillating sanding movement.

According to the invention, therefore, an oscillating sanding movement known from orbital sanders is combined with a rapidly changing activation of selected sanding regions in such a way that the oscillating sanding movement is independent of the activation of the various regions of the abrasive. In contrast to conventional pressure shoes, however, the activating device according to the invention does not serve to assist the sanding of defined contours and prevent rotary sanding of workpiece edges. Rather, an image of the sanding marks is produced by the alternate activation of various regions of the abrasive, this image thereby preventing an oscillating sanding movement from producing a regular sanding pattern. In addition, the alternate activation of the various regions ensures that sanding dust can be optimally discharged via the regions that are not activated.

The alternate activation is preferably effected in a rapidly changing manner with regard to the relative feed rate between workpiece and sanding machine.

The activating regions are preferably triggered asynchronously relative to the oscillating sanding movement, so that the grain of the sanding belt is not in use continuously and the sanding patterns are obliterated by the irregularly activated sanding regions.

The activating device can preferably be moved transversely to the feed direction of the workpiece to be sanded. It is especially advantageous in this case if the activating regions of the activating device are raised lamellae on a carrier which is preferably designed as a plate which can be moved in a reciprocating manner in the sanding plane transversely to the feed direction of the workpiece. Due to the reciprocating lamellae, which rest on the abrasive, the abrasive is pressed onto the workpiece only in the region of the lamellae. In this case, the reciprocating movement, running transversely to the feed direction, of the plate is uncoupled from the feed movement and the oscillating sanding movement.

As an alternative to this, the lamellae may also be mounted on an endless conveying means, for example a chain conveyor, the endless conveying means being driven in a revolving manner in the sanding plane transversely to the feed direction of the workpiece.

The revolving drive is again uncoupled from the oscillating sanding movement and is preferably opposed to the oscillating sanding movement in the sanding plane.

The lamellae may extend relative to the sanding plane, for example, diagonally, in a V shape, in a W shape, in a curved manner or so as to be offset one behind the other. These and other lamellae forms should be selected as a function of the construction of the sanding machine, of the type of oscillating sanding movement and of the sanding result.

Furthermore, it is advantageous if a pressure device known per se having at least one pressure shoe which can be triggered is arranged between the activating regions of the activating device and the abrasive. In contrast to the activating device according to the invention, this pressure device serves to apply pressure to the abrasive as a function of the contour of the workpiece, for example to prevent excessive sanding of marginal regions of the workpiece.

In an especially advantageous embodiment of the sanding machine, the abrasive, for example as a sanding sheet, is mounted on a retaining device. The retaining device is mounted with the oscillation drive means on a sanding machine frame in such a way that the retaining device, relative to the sanding machine frame, is set in a sanding movement oscillating parallel to a sanding plane, i.e. the sanding surface of the abrasive. According to the invention, the activating device is coupled to the sanding machine frame and is uncoupled from the retaining device at least in one direction of the sanding plane. This ensures that the alternate activation of the various regions of the abrasive is independent of the oscillating sanding movement.

In this case, the oscillation drive means preferably have rotatably driven eccentric shafts which extend vertically to the sanding plane between the sanding machine frame and the retaining device.

A rotating oscillating movement in the sanding plane is produced by the eccentricity of the driven shafts. At least one of the eccentric shafts should be displaceably mounted in one direction of the sanding plane in order to reduce bearing loads which occur due to different linear expansions during heating of the sanding machine. With a rigid bearing arrangement in the longitudinal direction of the eccentric shaft and in the other directions of the sanding plane, a full oscillation stroke of the retaining device relative to the sanding machine frame is ensured.

In another embodiment, the activating device has flexible conduits for receiving a medium and pressure control means which are connected to the conduits. The conduits provided may be tubes or chambers. The pressure control means are provided in order to pressurize in a pulsating manner medium located in the conduits, such as, for example, air or hydraulic fluid. In this way, pulsating waves of the medium are produced in conduit tubes, these waves exerting an increased pressure force on the abrasive adjoining the conduits in the region of the antinodes for the activation. In the case of chambers as flexible conduits, the various chambers can be triggered individually in order to apply pressure alternately to the various regions of the abrasive which adjoin the chambers.

The sanding machine may be designed as an orbital sander having a sanding sheet which is interchangeably connected to the retaining device, for example in a clamping or adhering manner. However, the abrasive may also be a revolving endless sanding belt.

An especially uniform sanding pattern can be achieved if a plurality of activating devices of the type described above are arranged next to one another in the feed direction. The activating devices may be displaceably mounted on a common supporting beam. The supporting beam is then moved in a reciprocating manner transversely to the feed direction, whereas the activating devices are in turn moved in a reciprocating manner relative to the supporting beam, for example in the longitudinal direction of the supporting beam.

The object is also achieved by a method of sanding a workpiece using a sanding machine described above by alternate activation of the abrasive in various regions of the abrasive, the activated regions being triggered independently of the oscillating sanding movement.

BRIEF DESCRIPTION OF THE DRAWINGS

The invention is explained in more detail below with reference to the attached drawings. In the drawing.

DETAILED DESCRIPTION OF EMBODIMENTS OF THE INVENTION

Figure 1:
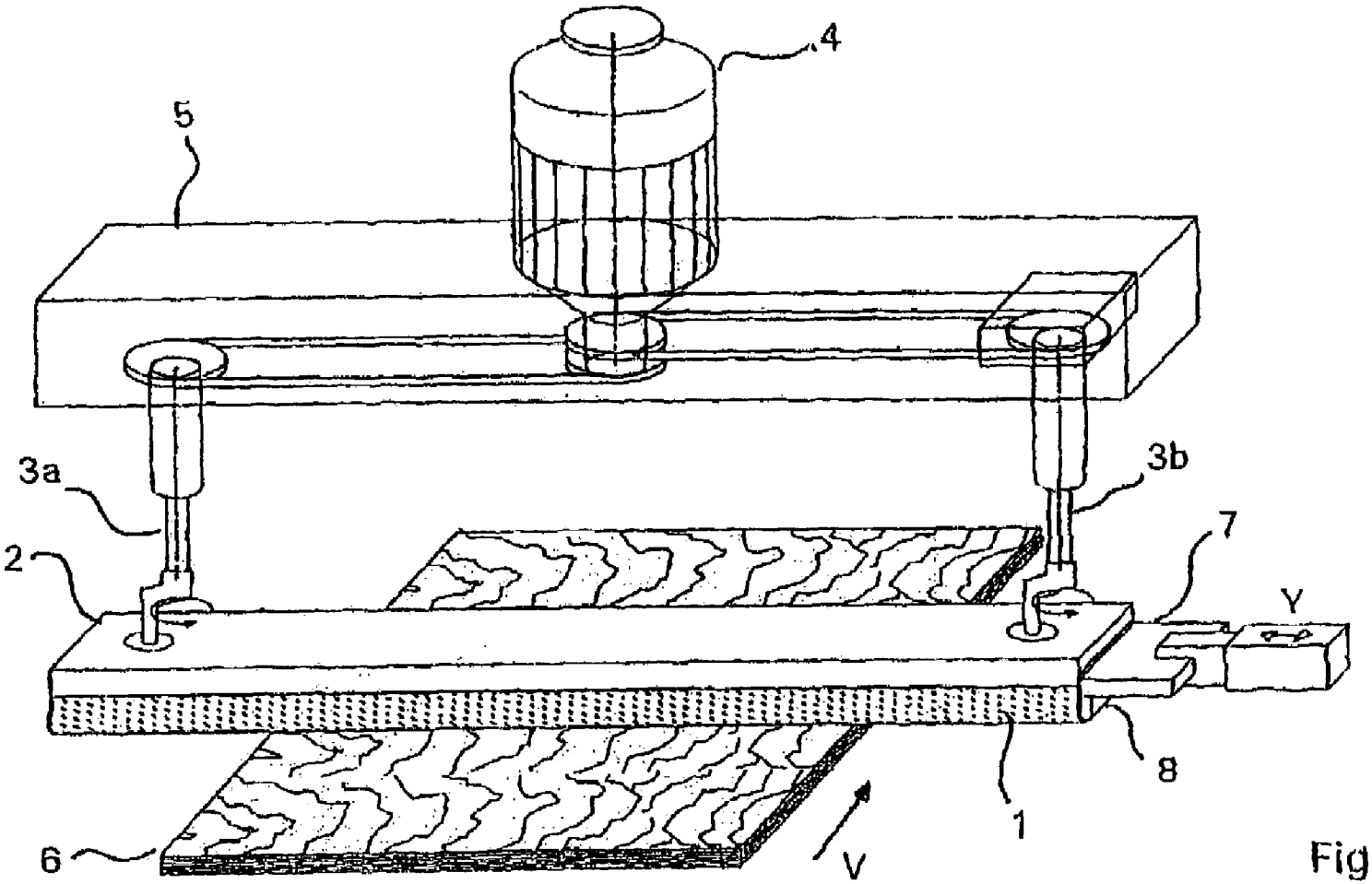
FIG. 1 shows a perspective view of a first embodiment of a sanding machine according to the invention.

FIG. 1 is a view transverse to the feed direction V, shows a sanding machine according to the invention in cross section. An abrasive 1 in the form of a sanding sheet or sanding belt is interchangeably attached to a retaining device 2. The retaining device 2 is in turn carried transversely to the sanding plane, i.e. the sanding surface of the abrasive 1, by at least one eccentric shaft 3, which can be rotatably driven at variable speeds by an electric motor 4. An orbital sanding movement of the abrasive 1 in the sanding plane is produced by the eccentric shaft 3. The electric motor 4 is in turn firmly connected to a sanding machine frame 5. The bearing arrangement of at least one of the eccentric shafts 3 provided should be displaceable in one direction of the sanding plane, preferably in the Y direction transversely to the feed direction V, in order to compensate for linear expansions during heating of the sanding machine and to reduce the bearing load. In the direction in which the eccentric shaft 3 extends and also in the other directions of the sanding plane, the eccentric shaft 3 is preferably mounted rigidly and not flexibly in order to ensure the full oscillation stroke of the retaining device 2.

The abrasive 1 can be clamped, for example, onto the retaining device 2, can be tacked to the latter by a hook-and-loop connection or can be releasably connected thereto in another way. The sanding machine may likewise be designed with a sanding belt, drive rollers and/or deflection devices for an endless sanding belt being coupled to the retaining device 2.

A workpiece 6 is guided along the sanding machine in feed direction V relative to the sanding belt 1. For the embodiment of a portable sanding machine, this portable sanding machine may also be moved relative to a fixed workpiece 6.

According to the invention, an activating device 7 having a multiplicity of activating regions 8, for example in the form of lamellae, which rest on the abrasive 1 is provided between the retaining device 2 and the abrasive 1. The activating device 7 is moved independently of the oscillating sanding movement of the abrasive 1, for example in the sketched Y direction transversely to the feed direction V, and is preferably directly coupled to the sanding machine frame 5. In this case, it is essential to the invention that the activating regions 8 of the activating device 7 are activated in such a way that various regions of the abrasive 1 are alternately pressed onto the workpiece 6 by the activating regions 8 independently of the oscillating sanding movement. The superimposed movements, not synchronized with one another, of the retaining device 2 (oscillating sanding movement) and the activating device 7 (reciprocating movement) ensure that a regular sanding pattern on account of the oscillating sanding movement is obliterated and the resulting sanding quality can thereby be considerably improved.

This result is essentially achieved by virtue of the fact that the activating device 7 does not perform the oscillating movements of the sanding belt 1 but is largely uncoupled therefrom.

Figure 2:
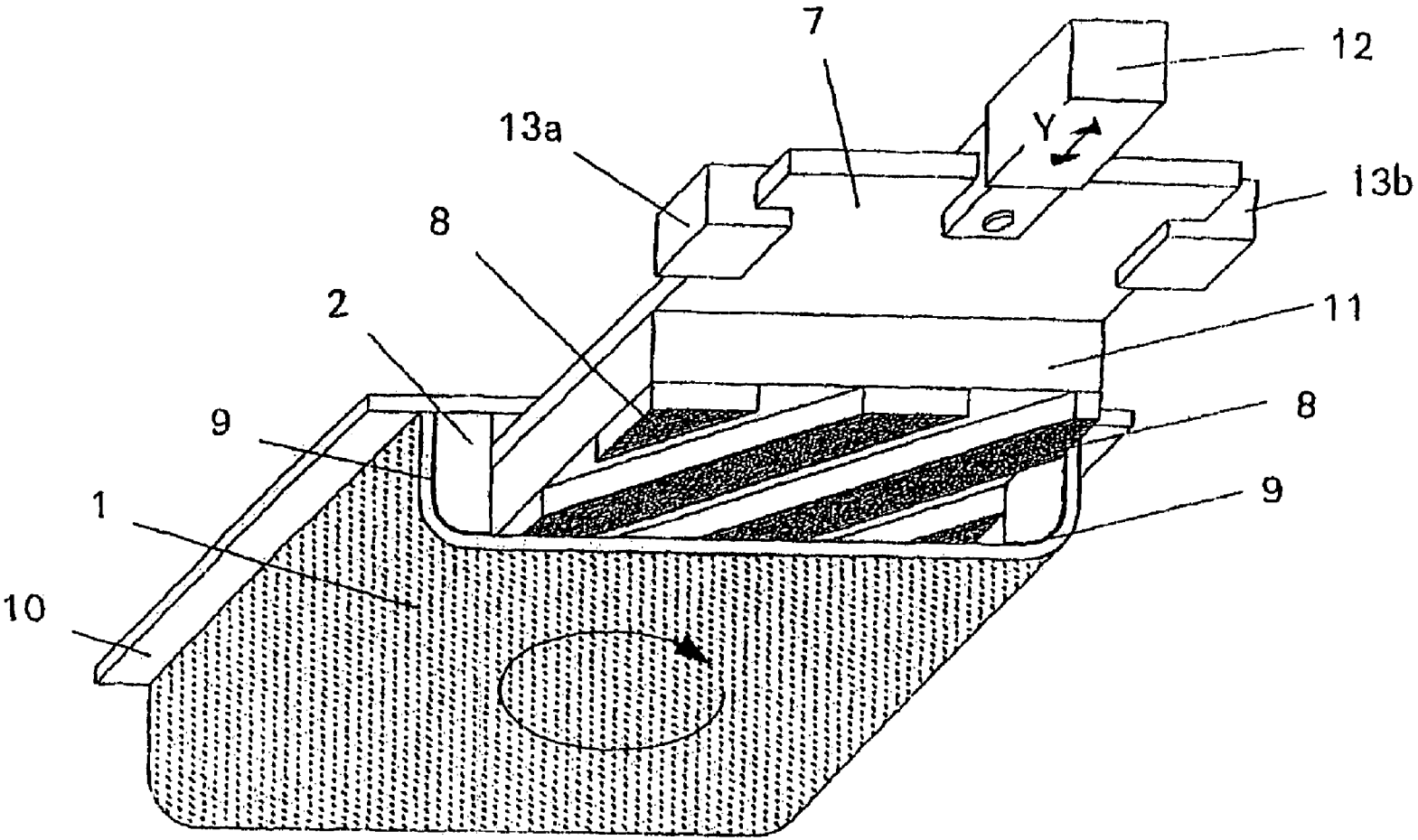
FIG. 2 shows a perspective view of a detail of a sanding machine having a retaining device for abrasive and an activating device.

FIG. 2 shows a detail of the sanding machine from FIG. 1 as a perspective view.

It becomes clear that the abrasive 1 is interchangeably attached to a retaining plate 10 of the retaining device 2 by means of retaining rails 9, for example in a clamping or adhering manner. In this case, the abrasive 1 is tensioned via activating regions 8 in the form of diagonally running lamellae of a plate-shaped carrier 11 of the activating device 7. The plate-shaped carrier 11 of the activating device 7 is moved in a reciprocating manner in the depicted Y arrow direction transversely to the feed direction V by means of a motion device 12. In this case, the motion device 12 is preferably coupled directly to the sanding machine frame 5. The plate-shaped carrier 11 is guided laterally and vertically in guide elements 13*a*, 13*b*.

Whereas the abrasive 1 is set in a rotating oscillating sanding movement with the retaining device 2, a reciprocating movement, independent thereof, of the activating device 7 is effected in the Y direction. The plate-shaped carrier 11 is not affected by the oscillating sanding movement and is mounted on the retaining device 2 in a freely displaceable manner in the sanding plane for this purpose.

The activating regions 8 may be raised diagonal lamellae as shown for example, but may also be V-shaped, W-shaped or curved raised lamellae, raised lamellae arranged offset one behind the other or even irregularly arranged raised lamellae. Further forms of the activating regions 8 are conceivable.

Essential is the resulting effect that only certain regions of the abrasive 1 are always pressed against the workpiece 6 by the activating device 7 moved rapidly in a reciprocating manner, while the abrasive 1 is set in a rapid sanding oscillation by the retaining device 2. A uniform pattern would be produced on the workpiece 6 by the oscillating sanding movement. Owing to the fact that now only certain regions of the abrasive 1 are always activated, the otherwise uniform sanding marks are obliterated and better dust control is also obtained below the sanding belt.

At least one further oscillating movement may be optionally superimposed on the simple oscillating movement of the retaining device 2.

Figure 3:
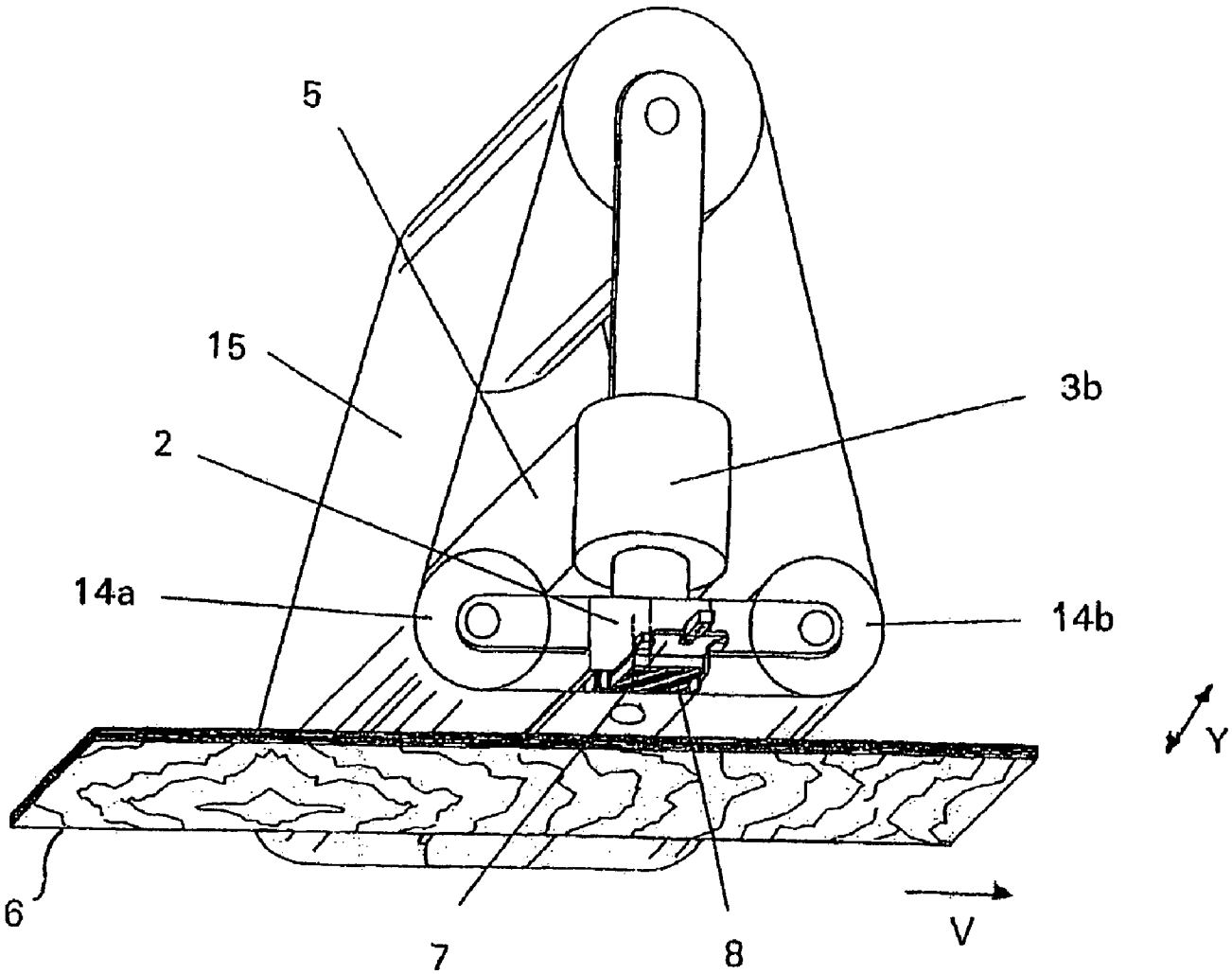
FIG. 3 shows a perspective view of a second embodiment of a sanding machine according to the invention having an endless sanding belt.

FIG. 3 shows a perspective view of a sanding machine having a revolving endless sanding belt 15 and an activating device 7 according to the invention. Deflection and/or drive rollers 14*a*, 14*b* for the revolving endless sanding belt 15 are carried by a retaining device 2 which is set in an oscillating sanding movement relative to the sanding machine frame 5. To this end, at least one rotationally driven eccentric shaft 3*b* is again arranged between the sanding machine frame 5 and the retaining device 2.

The activating regions 8 of the activating device 7 rest on the inner surface of the endless sanding belt 15 in such a way that the sanding belt 15 is pressed at the pressure regions 8 onto a workpiece (not shown) which is moved below the sanding belt 15 in feed direction V relative to the sanding machine.

Figure 4:
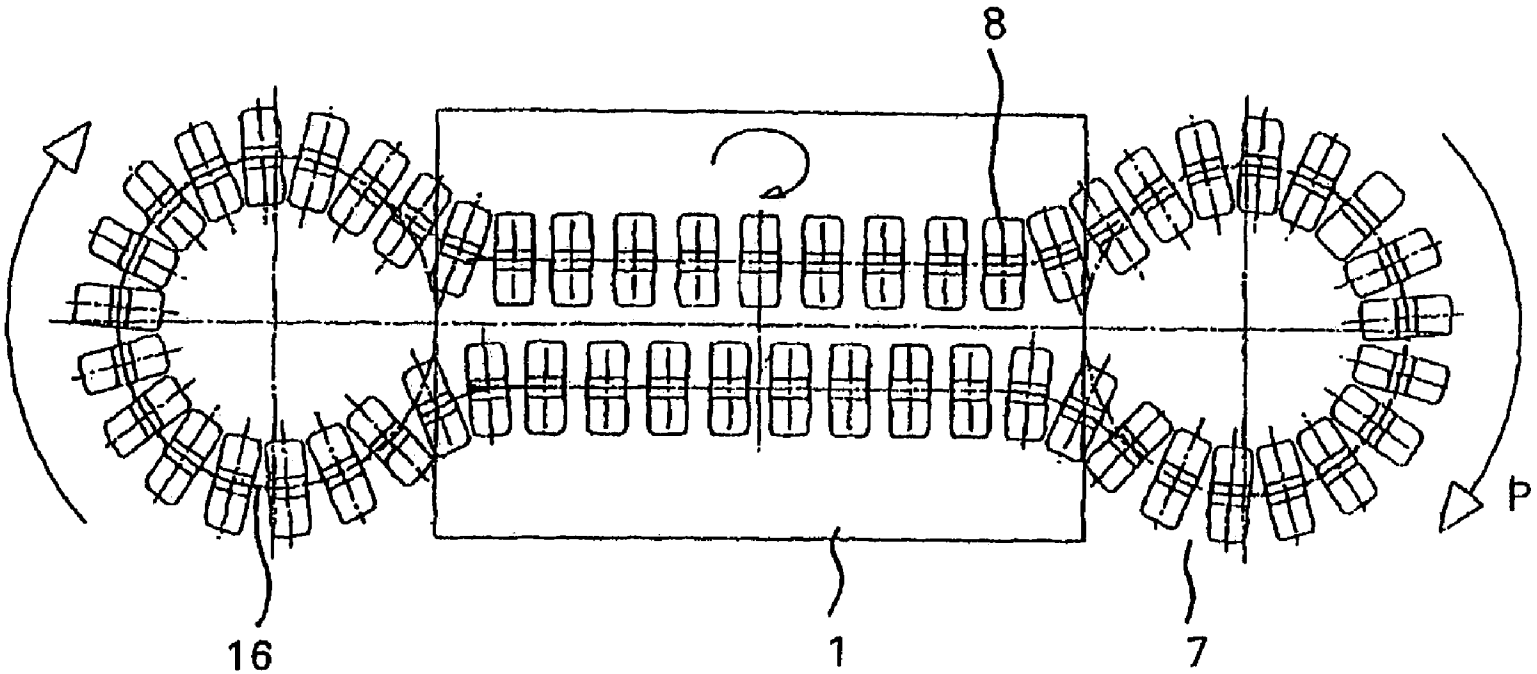
FIG. 4 shows a plan view of an activating device having an endless conveying belt carrying lamellae.

FIG. 4 shows another embodiment of an activating device 7 in plan view. An endless conveying belt 16 is tensioned parallel to the sanding plane transversely to the feed direction V and carries a multiplicity of spaced-apart activating regions 8 in the form of contact shoes. The contact surfaces of the contact shoes rest on the abrasive 1 in order to press the latter in the region of the contact shoes onto the workpiece 6 to be sanded. The endless conveying belt 16 is, for example, an endless chain deflected with sprocket wheels and driven in arrow direction P.

Figure 5:
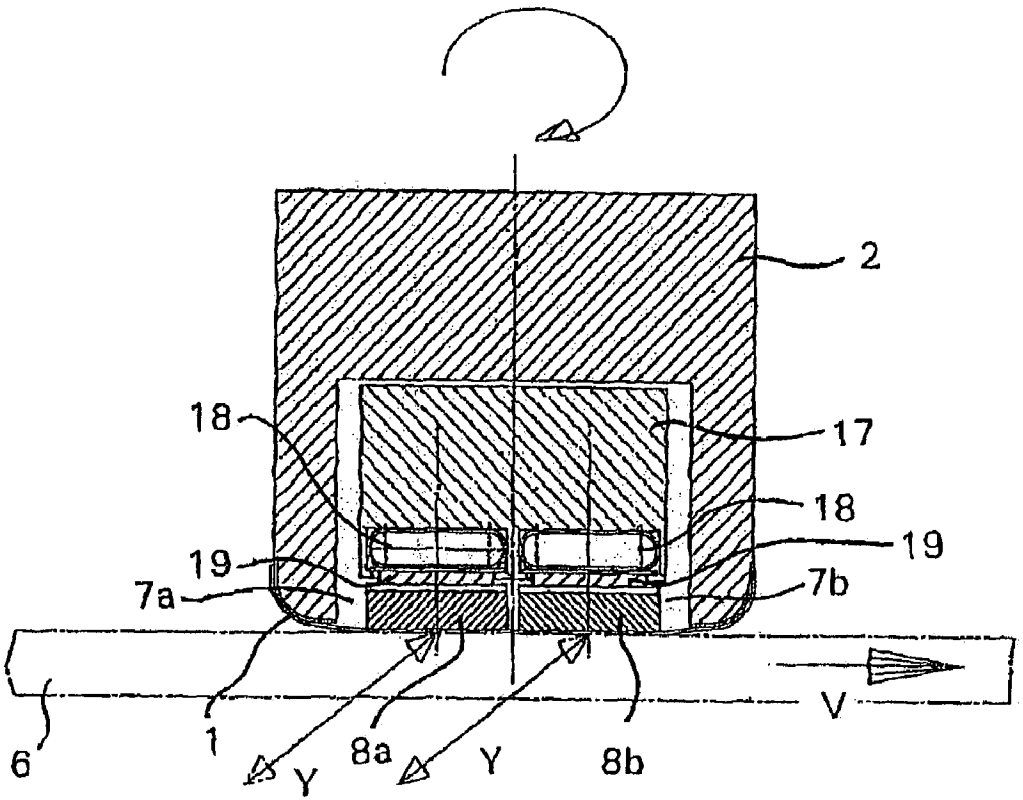
FIG. 5 shows a cross-sectional side view of a detail of a third embodiment of a sanding machine according to the invention having two activating devices arranged next to one another in parallel.

FIG. 5, in side view transversely to the feed direction V, shows a detail of a third embodiment of the sanding machine according to the invention having two activating devices 7*a*, 7*b* arranged next to one another in parallel. The activating devices 7*a*, 7*b* each have a multiplicity of activating regions 8*a*, 8*b*, that extend transversely to the feed direction V and are aligned with the sanding plane. A supporting beam 17 is provided, which is either firmly mounted on the sanding machine frame 5 or is mounted on the retaining device 2 in such a way as to be displaceable in at least one direction parallel to the sanding plane, so that the movement of the supporting beam 17 is largely uncoupled from the oscillating sanding movement of the retaining device 2.

Instead of a mechanical activating device, one or more flexible conduits 18 or chambers may interact with the abrasive 1 as shown in FIG. 5. The medium located in the conduits 18 or conduit chambers is pressurized in a pulsating manner by pressure control means, so that the regions of the abrasive 1 which are adjacent to the chambers to which pressure is applied or the regions of the flexible conduits 18 in the region of the antinodes are pressed against the workpiece 6. By selection of the pulse control or the activation of the individual chambers, the various regions of the abrasive 1 can be pressed alternately against the workpiece 6 independently of the oscillating sanding movement.

The activating regions 8*a*, 8*b* are rigidly mounted on the supporting beam 17 in feed direction V by means of guide elements 19. The activating devices 7*a*, 7*b* may in turn again be mounted together with the conduits 18 on the supporting beam 17 in such a, way as to be displaceable vertically to the sanding plane and may perform an additional reciprocating movement.

The medium used may be, for example, air or hydraulic fluid.

Figure 6:
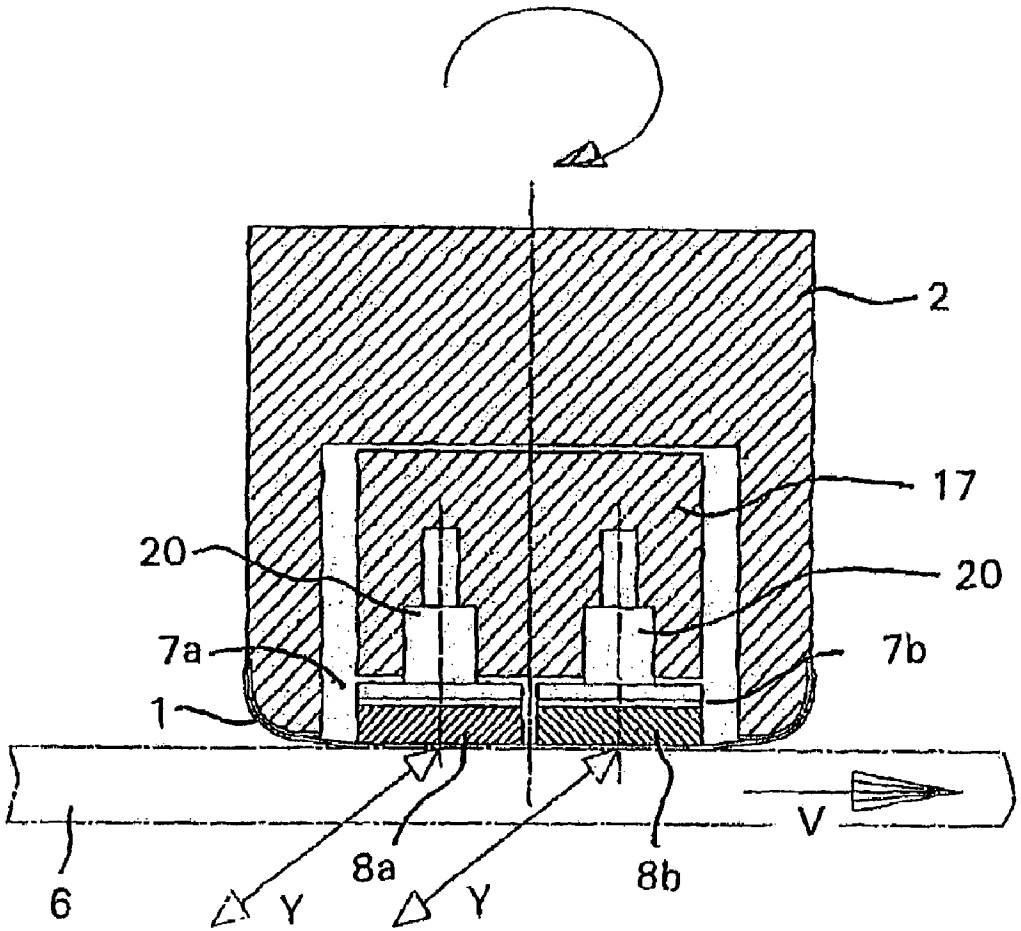
FIG. 6 shows a cross-sectional side view of a detail of a sanding machine having additional pressure devices.

FIG. 6 shows a detail of a fourth embodiment of the sanding machine according to the invention having two activating devices 7*a*, 7*b* which are arranged next to one another in parallel and have an additional pressure device known per se which has a multiplicity of pressure shoes 20. By means of the pressure shoes 20, which can preferably be triggered individually, the respective activating regions 8 arranged thereon can be displaced vertically to the sanding plane.

The pressure shoes 20 are fastened to a supporting beam 17, which in turn is mounted so as to be movable in a reciprocating manner transversely to the feed direction V in order to activate the activating regions 8 independently of the oscillating sanding movement.

Figure 7:
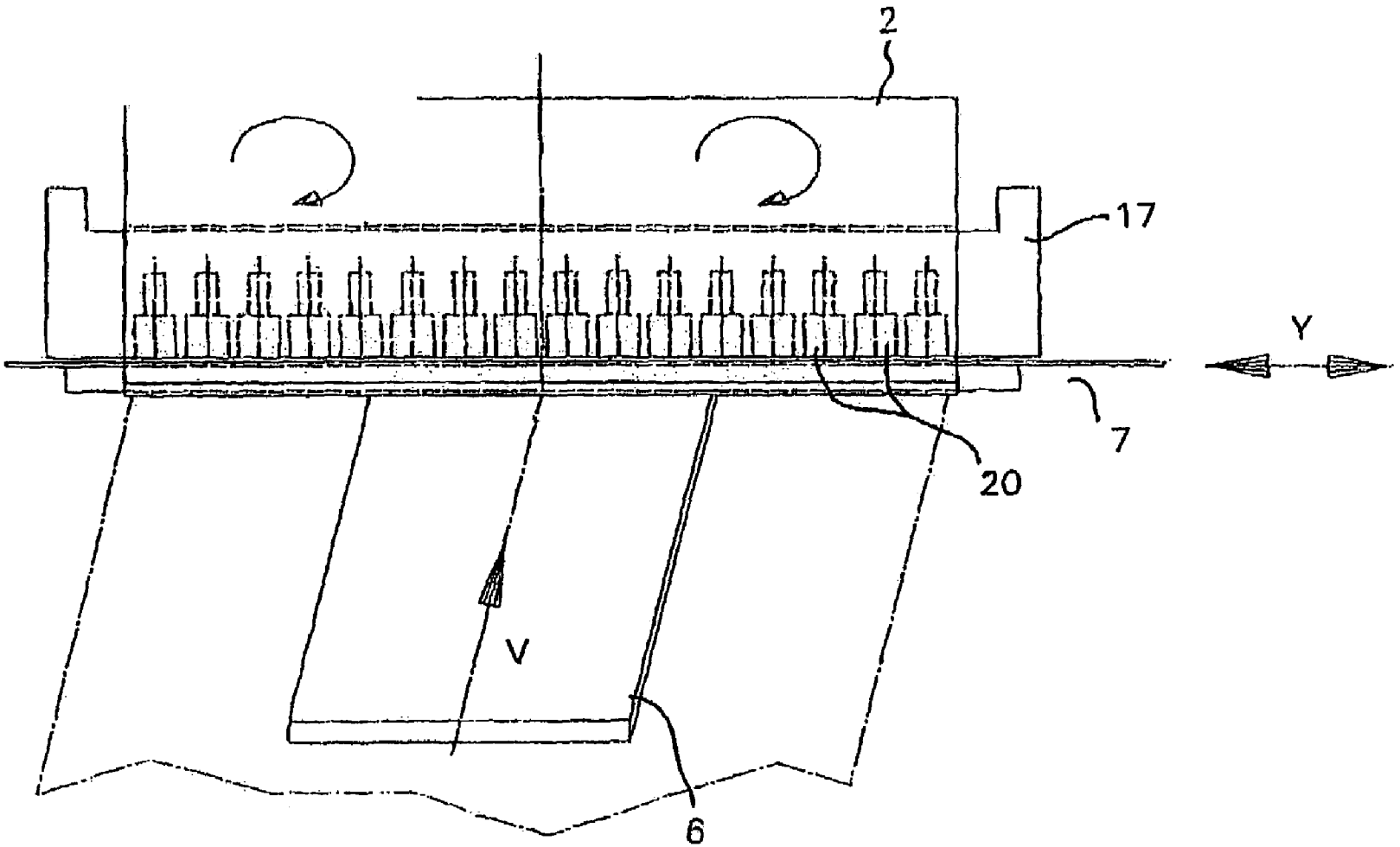
FIG. 7 shows a front view of the sanding machine extending transversely to the feed direction and having additional pressure devices from FIG. 6.

FIG. 7 shows the sanding machine of the embodiment shown in FIG. 6 in front view. It becomes clear that the activating device 7 extends parallel to the sanding plane transversely to the feed direction V, and a multiplicity of pressure shoes 20 of a pressure device known per se are provided spaced apart in the longitudinal direction of the activating device 7. The pressure shoes 20 can be triggered, for example, individually in order to specifically control the pressure force in certain regions, in particular in order to prevent rotary sanding in marginal contours of the workpiece 6.

The invention claimed is:

1. A sanding machine having oscillation drive means for setting an abrasive in an oscillating sanding movement, comprising an activating device having a multiplicity of activating regions triggered in such a way that various regions of the abrasive are alternately activated independently of the oscillating sanding movement, wherein the abrasive is mounted on a retaining device and the retaining device is mounted with the oscillation drive means on a sanding machine frame in order to set the retaining device, relative to a sanding machine frame, in a sanding movement oscillating parallel to a sanding plane, which is defined by a sanding surface of the abrasive, wherein the activating device is coupled to the sanding machine frame and is uncoupled from the retaining device at least in one direction of the sanding plane, and the oscillation drive means have rotatably driven eccentric shafts which extend vertically with respect to a sanding plane, between the sanding machine frame and the retaining device, at least one of the eccentric shafts is displaceably mounted in one direction of a sanding plane.

2. The sanding machine as claimed in claim 1, wherein the activating regions of the activating device are raised lamellae arranged on a carrier.

3. The sanding machine as claimed in claim 1, wherein the activating regions extend in a form of raised lamellae on a sanding plane diagonally, in a V shape, in a W shape, in a curved manner or so as to be offset one behind the other.

4. The sanding machine as claimed in claim 1, further comprising a pressure device having at least one pressure shoe which can be triggered and is arranged between the activating regions of the activating device and the abrasive.

5. The sanding machine as claimed in claim 1, further comprising, a plurality of activating devices arranged one behind the other in the feed direction.

6. The sanding machine as claimed in claim 1, wherein the abrasive is a sanding sheet interchangeably connected to the retaining device.

7. The sanding machine as claimed in claim 1, wherein the activating device has flexible conduits for receiving a medium, and pressure control means are connected to the conduits, medium located in the conduits being pressurized in a pulsating manner by the pressure control means.

8. The sanding machine as claimed in claim 1, wherein the abrasive is a revolving endless sanding belt.

* * * * *